US005956293A

United States Patent [19]

Rorick

[11] Patent Number: 5,956,293

[45] Date of Patent: Sep. 21, 1999

[54] FLEXURAL PLATE SOUND TRANSDUCER HAVING LOW RESONANT FREQUENCY

[75] Inventor: Timothy P. Rorick, New Haven, Ind.

[73] Assignee: Raytheon Company, El Segundo, Calif.

[21] Appl. No.: 08/863,986

[22] Filed: May 27, 1997

[51] Int. Cl.[6] ..... H04R 17/00

[52] U.S. Cl. ..... 367/162; 367/176; 310/326

[58] Field of Search ..... 367/162, 165, 367/173, 176, 160; 310/326, 348

[56] References Cited

U.S. PATENT DOCUMENTS

| | | | |
|---|---|---|---|
| 3,321,189 | 5/1967 | Scarpa | 367/162 |
| 3,360,664 | 12/1967 | Straube | 367/160 |
| 3,497,731 | 2/1970 | Straube | 367/160 |
| 4,051,455 | 9/1977 | Fowler | 367/163 |
| 5,099,461 | 3/1992 | Fitzgerald | 367/160 |
| 5,406,531 | 4/1995 | Henriquez et al. | 367/157 |

*Primary Examiner*—Ian J. Lobo
*Attorney, Agent, or Firm*—Leonard A. Alkov; William C. Schubert; Glenn H. Lenzen, Jr.

[57] ABSTRACT

In a preferred embodiment, a flexural plate sound transducer (150), including: a housing (152) having an open central volume (172); a flexural plate (154) attached around an inner surface of the housing (152) and extending across the central volume (172); at least one piezoelectric element (162, 164) attached to a surface of the flexural plate (154); and a mechanical hinge (194) formed in the flexural plate (154) and extending around the flexural plate (154) near an outer periphery thereof, the mechanical hinge (194) being formed such as to cause the flexural plate (154) to move in a substantially piston-like manner when the piezoelectric element (162, 164) is energized.

12 Claims, 6 Drawing Sheets

FLEXURAL PLATE SOUND TRANSDUCER HAVING LOW RESONANT FREQUENCY

BACKGROUND OF THE INVENTION

1. Field of the Invention

The present invention relates to sound transducers generally and, more particularly, but not by way of limitation, to a novel flexural plate sound transducer having a low resonant frequency.

2. Background Art

Flexural plate sound transducers are widely used for producing sound from electrical signals or electrical signals from sound and are used especially in sonobuoys as both projectors and receivers of sound waves. Typically, such a transducer includes a cylindrical aluminum housing having an aluminum flexural plate extending across the interior of the housing orthogonal to the major axis of the housing. Ceramic piezoelectric elements are attached to at least one of the upper and lower surfaces of the flexural plate. The plate may be formed of one piece with the housing or it may be attached thereto with epoxy, bolts, or other, similar attachment means.

The resonant frequency of a conventional flexural plate transducer is controlled by the diameter of the plate, the plate thickness, and the outer edge mounting condition. This frequency is proportional to $(h^3/a^4)^{1/2}$, where "h" is the plate thickness and "a" is the plate radius. It is desirable that the resonant frequency be as low as possible while maintaining a given package size; however, in general, it is very difficult to repeatably control the edge mounting conditions of a flexural plate transducer using standard mounting techniques.

Particular features, elements, and advantages of the present invention, will be elucidated in, or be apparent from, the following description and the accompanying drawing figures.

SUMMARY OF THE INVENTION

The present invention provides, in a preferred embodiment, a flexural plate sound transducer, comprising: a housing having an open central volume; a flexural plate attached around an inner surface of said housing and extending across said central volume; at least one piezoelectric element attached to a surface of said flexural plate; and a mechanical hinge formed in said flexural plate and extending around said flexural plate near an outer periphery thereof, said mechanical hinge being formed such as to cause said flexural plate to move in a substantially piston-like manner when said piezoelectric element is energized.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
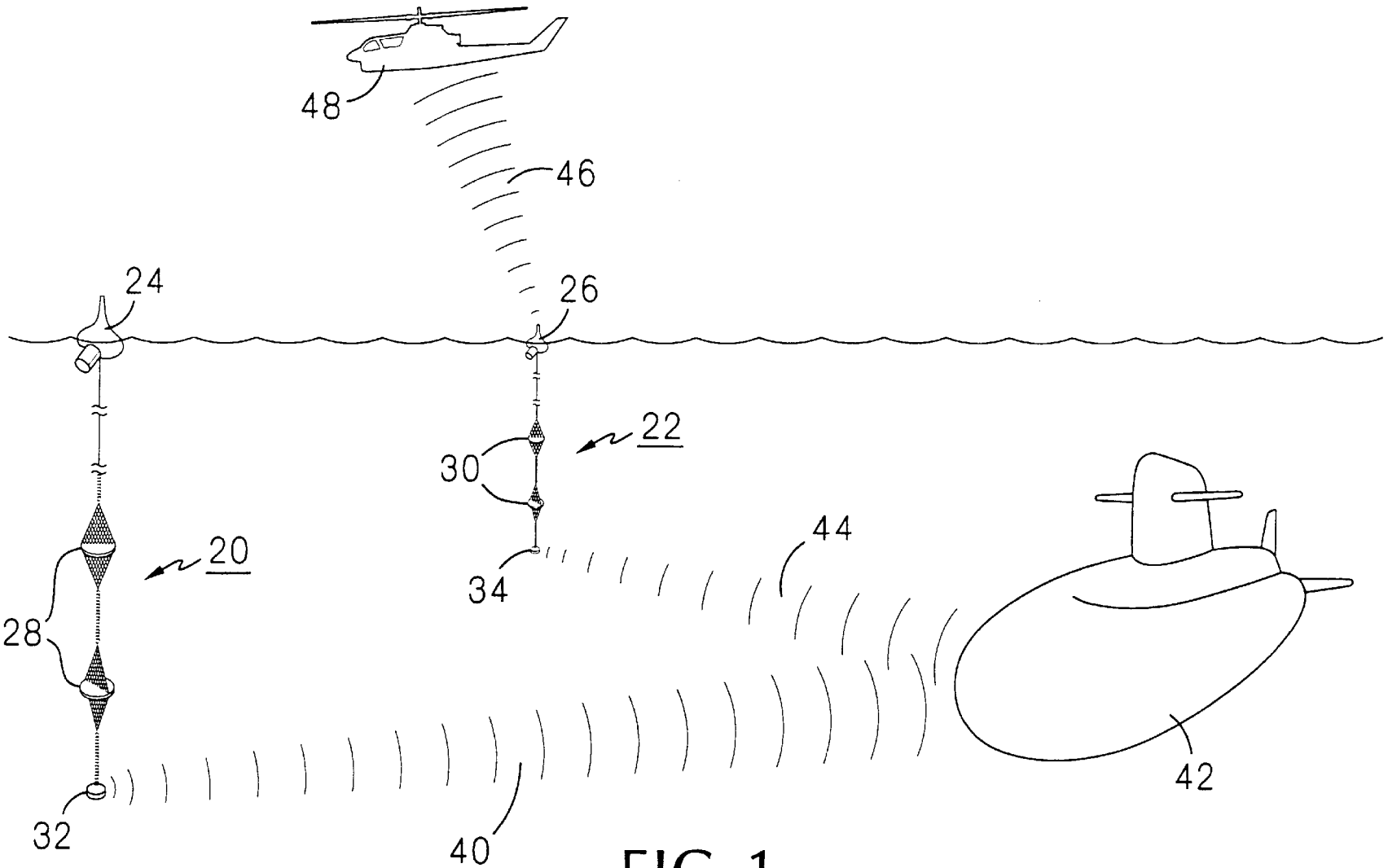
FIG. 1 is an isometric, schematic representation of a sonobuoy system in which the present invention may be employed.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a typical sonobuoy system in which the present invention may be employed. Here, first and second sonobuoys, generally indicated, respectively, by the reference numerals 20 and 22 have been deployed in the sea, each sonobuoy including, respectively, buoys 24 and 26 containing electronic circuitry and batteries (not shown), sea anchors 28 and 30, and flexural plate transducers 32 and 34 disposed at the lower ends of interconnecting cables and suspension means. Sonobuoy 20 serves as a projector, while sonobuoy 22 serves as a receiver. It will be understood that sonobuoys 20 and 22 have been deployed by conventional means from an airplane, a helicopter, or a ship.

In use, flexural plate transducer 32 on sonobuoy 20 emits a sound wave 40. Sound wave 40 is reflected from an underwater object, here a submarine 42, creating a sound wave 44 which is received by flexural plate transducer 34 on sonobuoy 22, that sonobuoy reporting the event via an RF signal 46 to a monitoring helicopter 48. This configuration is referred to as a bi-static configuration. However, if suitable control circuitry is provided, flexural plate transducer 32 is also capable to transmitting sound wave 40 into the water and receiving relection 44 from submarine 42, thus requiring only one sonobuoy.

Figure 2:
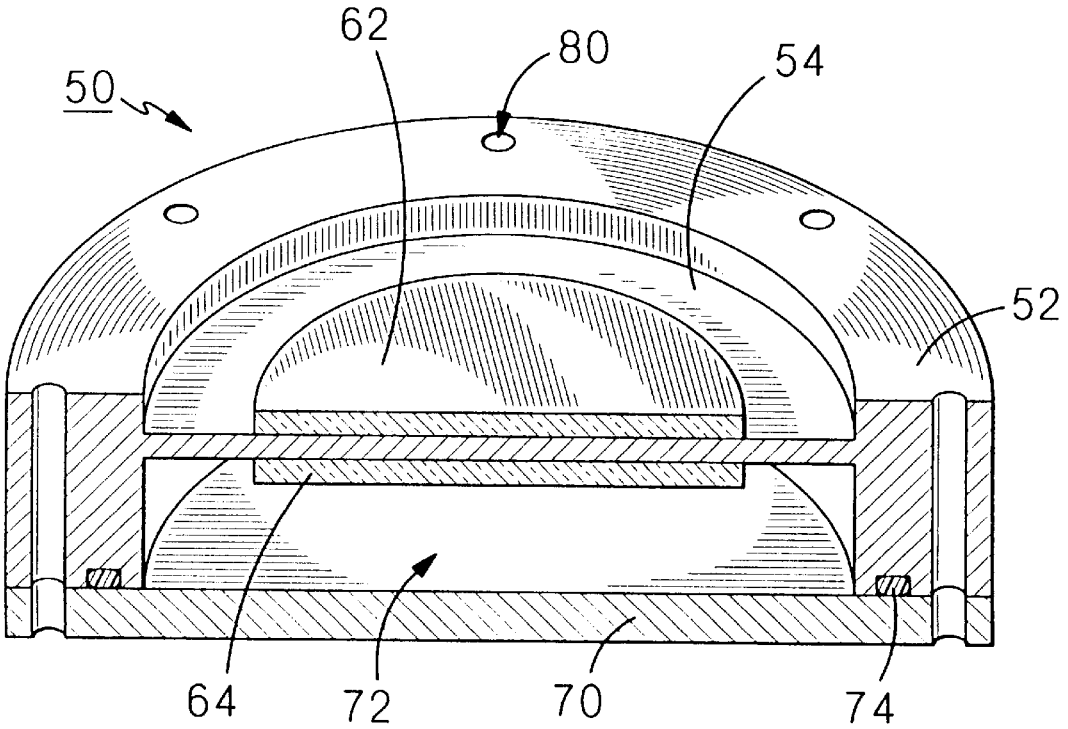
FIG. 2 (PRIOR ART)
FIG. 2 is an isometric view, in cross-section, of a conventional flexural plate transducer.

FIG. 2 illustrates the construction of a conventional flexural plate transducer, generally indicated by the reference numeral 50. Transducer 50 includes a cylindrical housing 52 having extending across the interior thereof, orthogonal to the major axis of the housing, a flexural plate 54. In this case, housing 50 and flexural plate 54 are of one-piece construction, but the flexural plate could also be a separate element attached by conventional means to the housing. Ceramic piezoelectric elements 62 and 64 are attached, respectively, to the upper and lower surfaces of flexural plate 54. A base plate 70 closes the bottom of housing 52, defining between the inner walls of the housing, the lower surface of flexural plate 54, and the inner surface of the base plate an air chamber 72 which is sealed by means of an O-ring 74. Suitable fastening means (not shown) are inserted through a plurality of holes, as at 80, to secure base plate 70 to housing 54. It will be understood that, when electrical signals are applied to ceramic elements 60 and 62, flexural plate 54 will flex at the frequency of the applied signals.

Base plate 70 can be replaced with a flexural plate transducer similar to plate 54 with ceramics similar to ceramics 62 and 64 attached thereto to create a bi-directional transducer.

Figure 3:
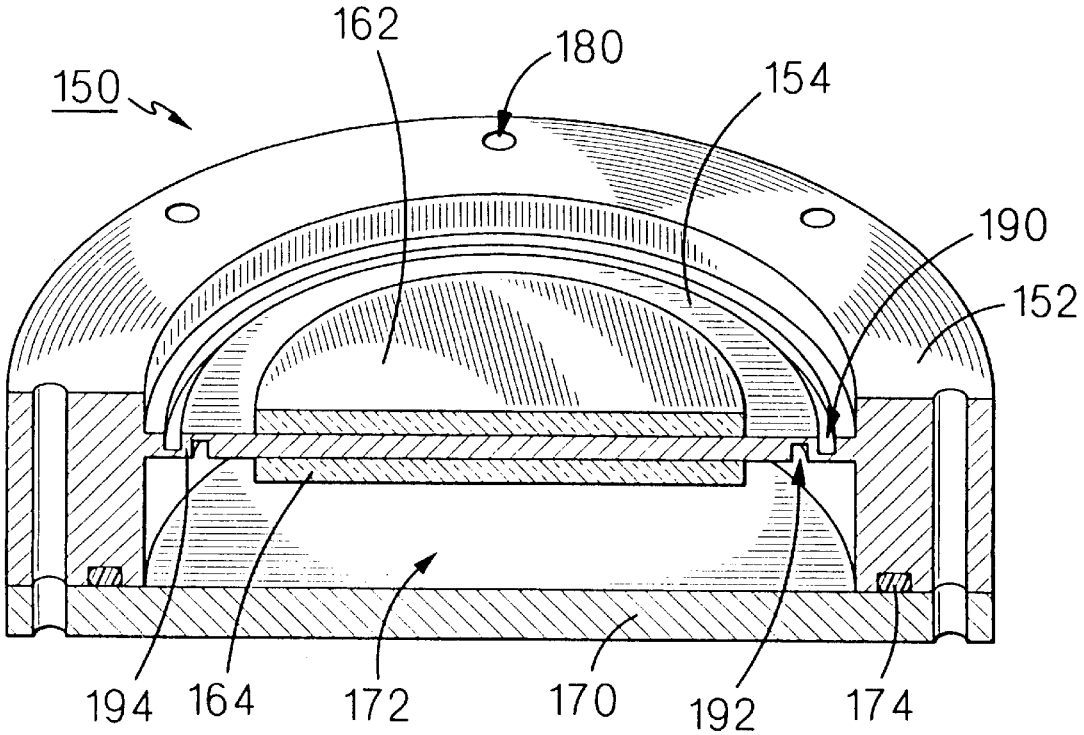
FIG. 3 is an isometric view, in cross-section, of a flexural plate transducer constructed according to one embodiment of the present invention.
Figure 4:
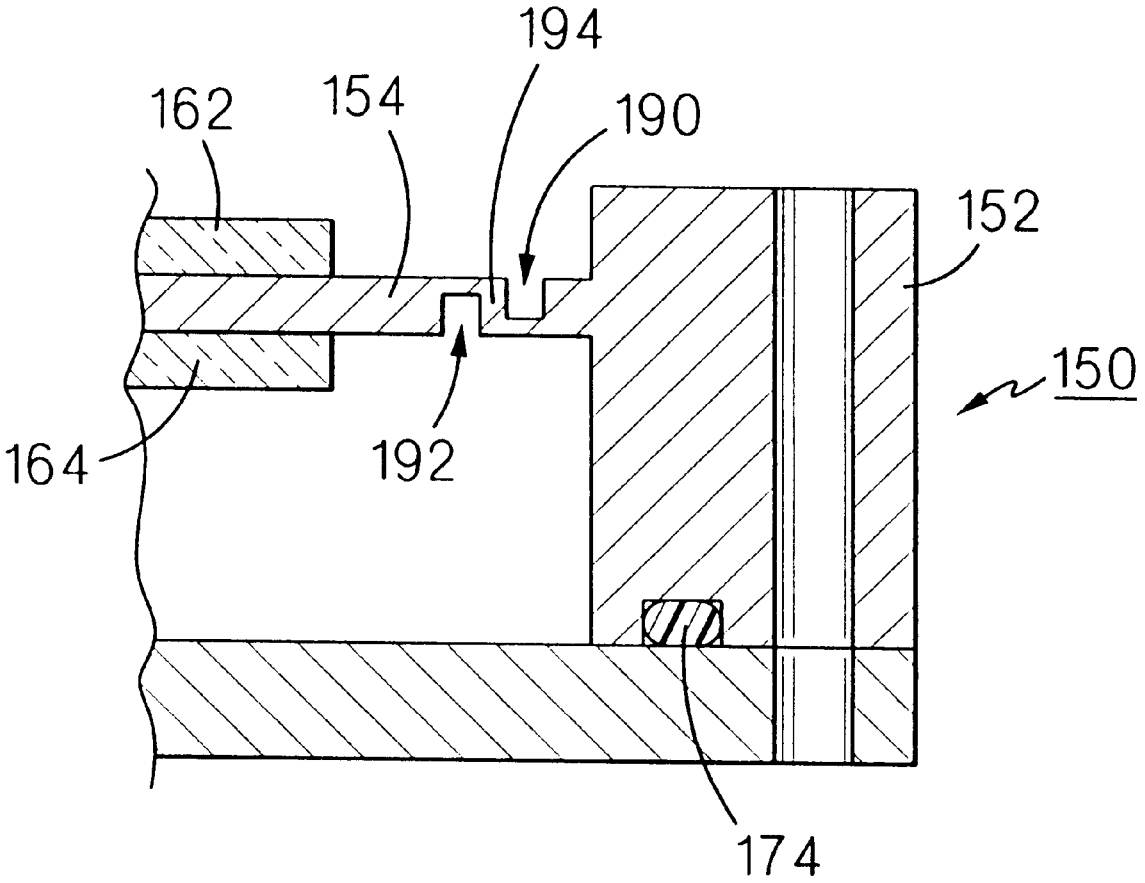
FIG. 4 is an enlarged, side elevational view, in cross-section of a portion of the flexural plate transducer of FIG. 3.

FIG. 3 illustrates a flexural plate transducer, generally indicated by the reference numeral 150, the elements thereof having the same reference numerals as flexural plate transducer 50 (FIG. 2), with the addition thereto of the prefix "1". With reference also to FIG. 4, transducer 150 is identical to transducer 50, except for the provision of parallel circular grooves 190 and 192 cut into flexural plate 154 near the perimeter thereof, with groove 190 being outboard of groove 192 and being cut into the upper surface of flexural plate 154, while groove 192 is cut into the lower surface of the flexural plate. Grooves 190 and 192 thus form a Z-shaped web, or "mechanical hinge", 194.

Hinge 194 controls the resonant frequency, mode shape, and boundary conditions of flexural plate 154 for a plate of given geometry. Additionally, hinge 194 reduces the effects of the outer edge boundary condition from influencing the resonant frequency of flexural plate 154. This removes the need for maintaining consistent edge condition around the circumference of flexural plate 154.

Hinge 194 also alters the mode shape of deformed flexural plate 154. The deformed shaped of flexural plate 154 will flatten out across the center of the plate with hinge 194 experiencing significant deformation, thus causing the mode shape to be closer to piston profile than that of a conventional, cantilevered flexural plate. This hinged mode shape substantially improves the radiated acoustic power (due to enlarged volumetric displacement for a given motion), raises cavitation thresholds, and lowers resonant frequency. The depth of grooves 190 and 192 along with their width and spacing determine the effective stiffness of flexural plate 154 and its resulting resonant frequency and mode shape for a given application.

As indicated above, hinge 194 permits the resonant frequency of flexural plate 154 to be lowered from that of a conventional flexural plate of given diameter and thickness. As additional ceramic is added to flexural plate 154, the resonant frequency of flexural plate 154 will increase until the stiffness of hinge 194 becomes less than the center plate stiffness. At this point, hinge 194 will control the resonant frequency of the plate. If additional ceramic is added or if the plate thickness is increased, no net increase in stiffness will occur, but the additional mass will tend to lower the resonant frequency of the system. This is in distinct contrast to a conventional flexural plate where increased thickness causes an increase in the stiffness of the system and an increase in the resonant frequency.

Figure 6:
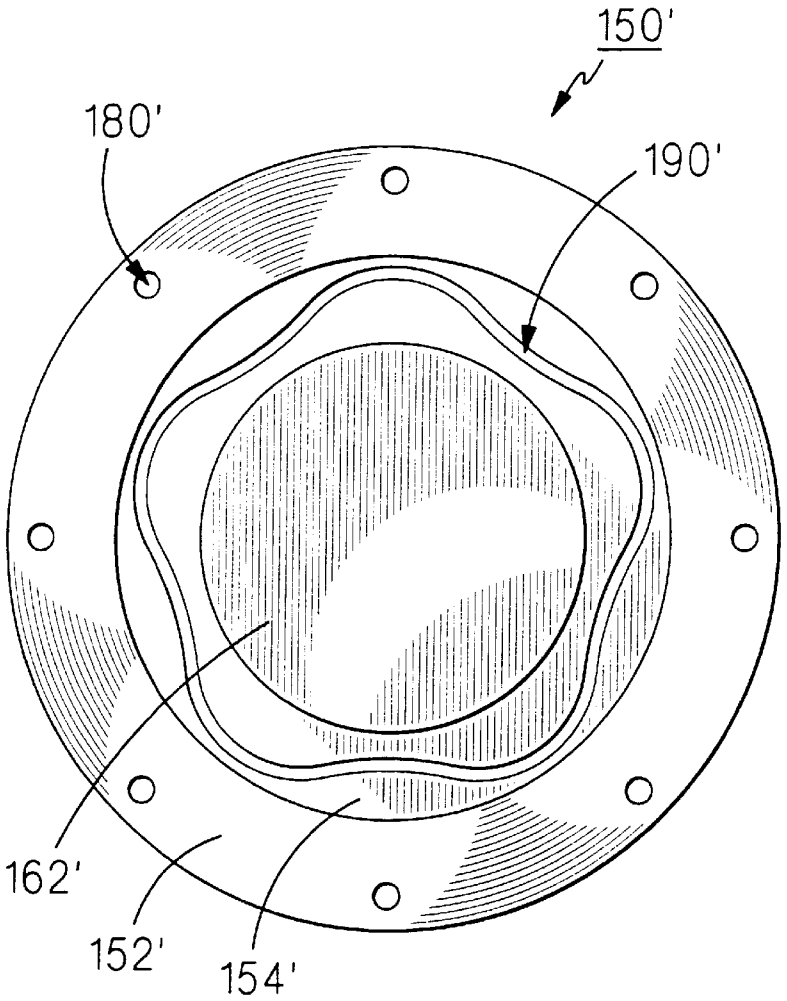
FIG. 6 is a top plan view of a flexural plate transducer constructed according to another embodiment of the present invention.
Figure 5:
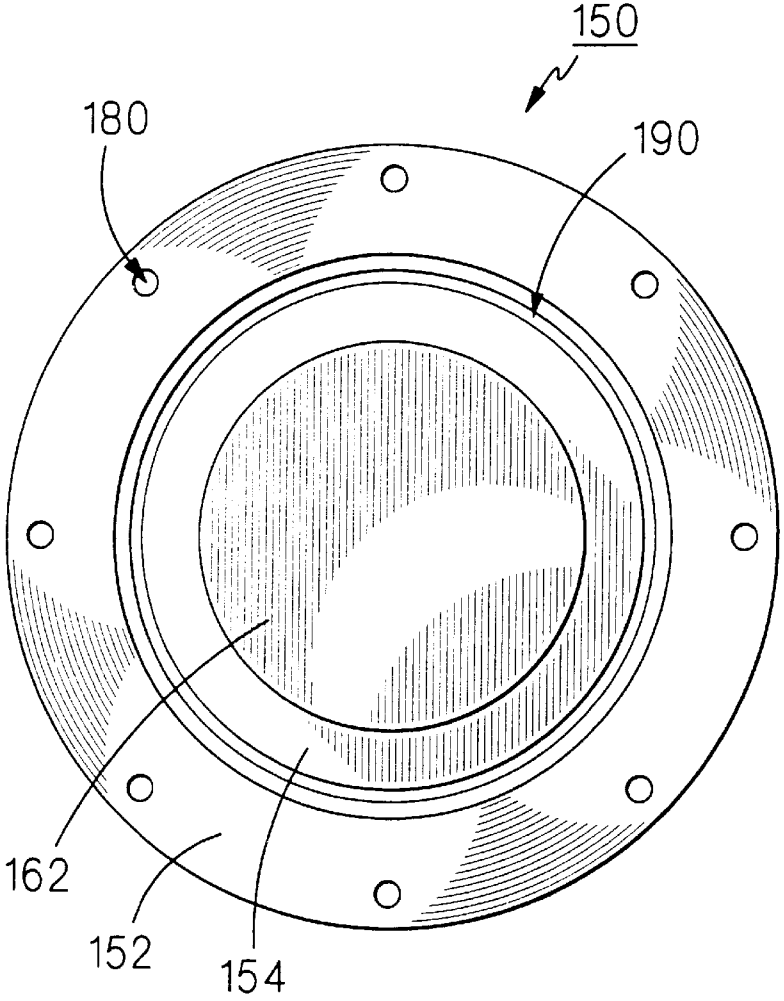
FIG. 5 is a top plan view of the flexural plate transducer of FIG. 3.

FIG. 5 is a top plan view of flexural plate transducer 150 and FIG. 6 is a top plan view of a flexural plate transducer according to another embodiment of the present invention, generally indicated by the reference numeral 150', elements of the latter similar to elements of the former being given primed reference numerals. As indicated on FIG. 6, groove 190' has a complex shape and it will be understood that a similar groove 192' is cut into the lower surface of flexural plate 154'. While the complex shape of groove 190' is shown as having a sinusoidal shape, any suitable complex shape may be employed. It will also be understood that, in cross-section, grooves 190' and 192' will have profiles similar to grooves 190 and 192 on FIG. 4. Many other variations are within the contemplation of the present invention, in order to achieve the desired hinge action for a particular application.

Figure 7:
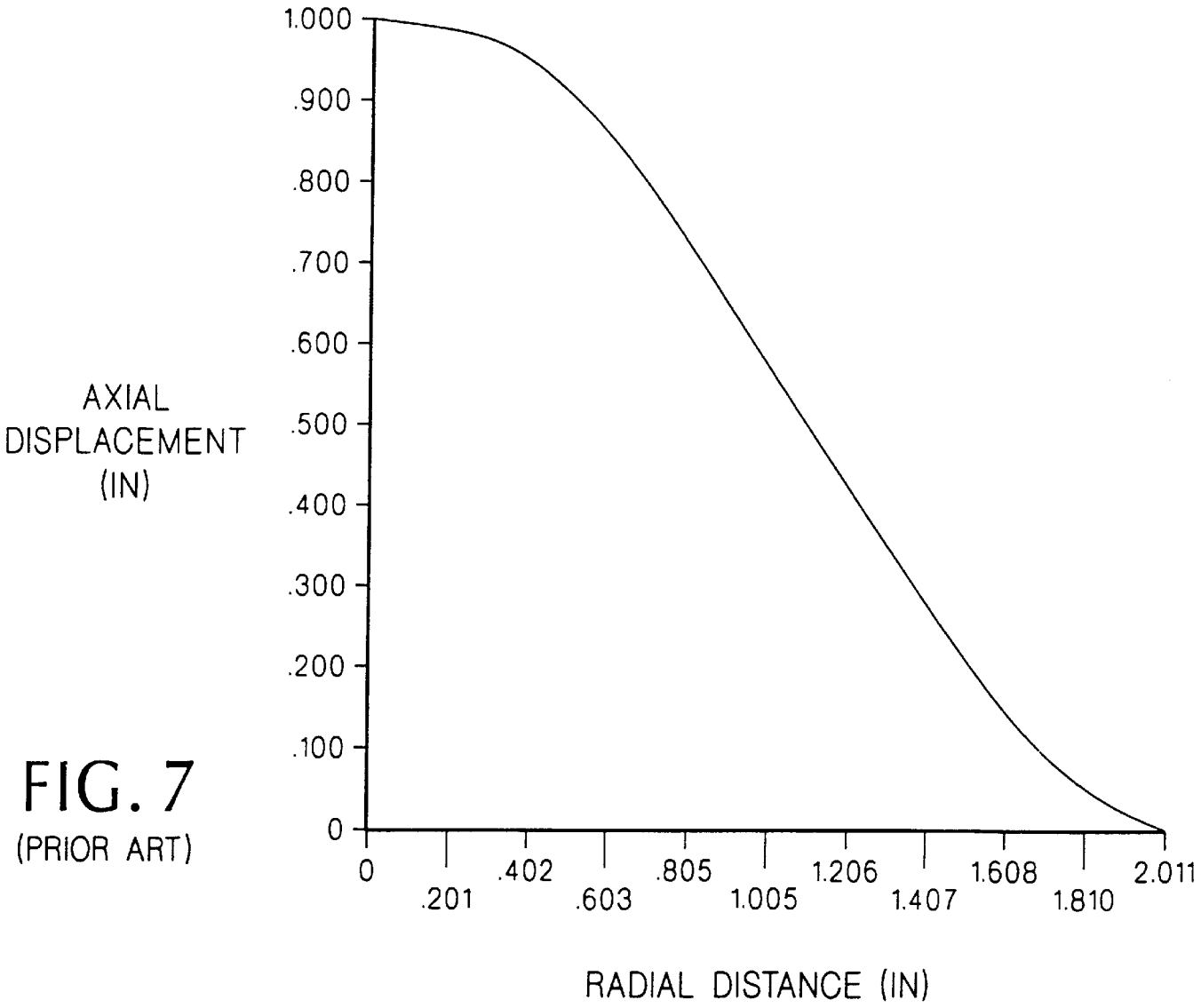
FIG. 7 (PRIOR ART)
FIG. 7 is a graph of axial displacement versus radial distance for a conventional flexural plate transducer.
Figure 8:
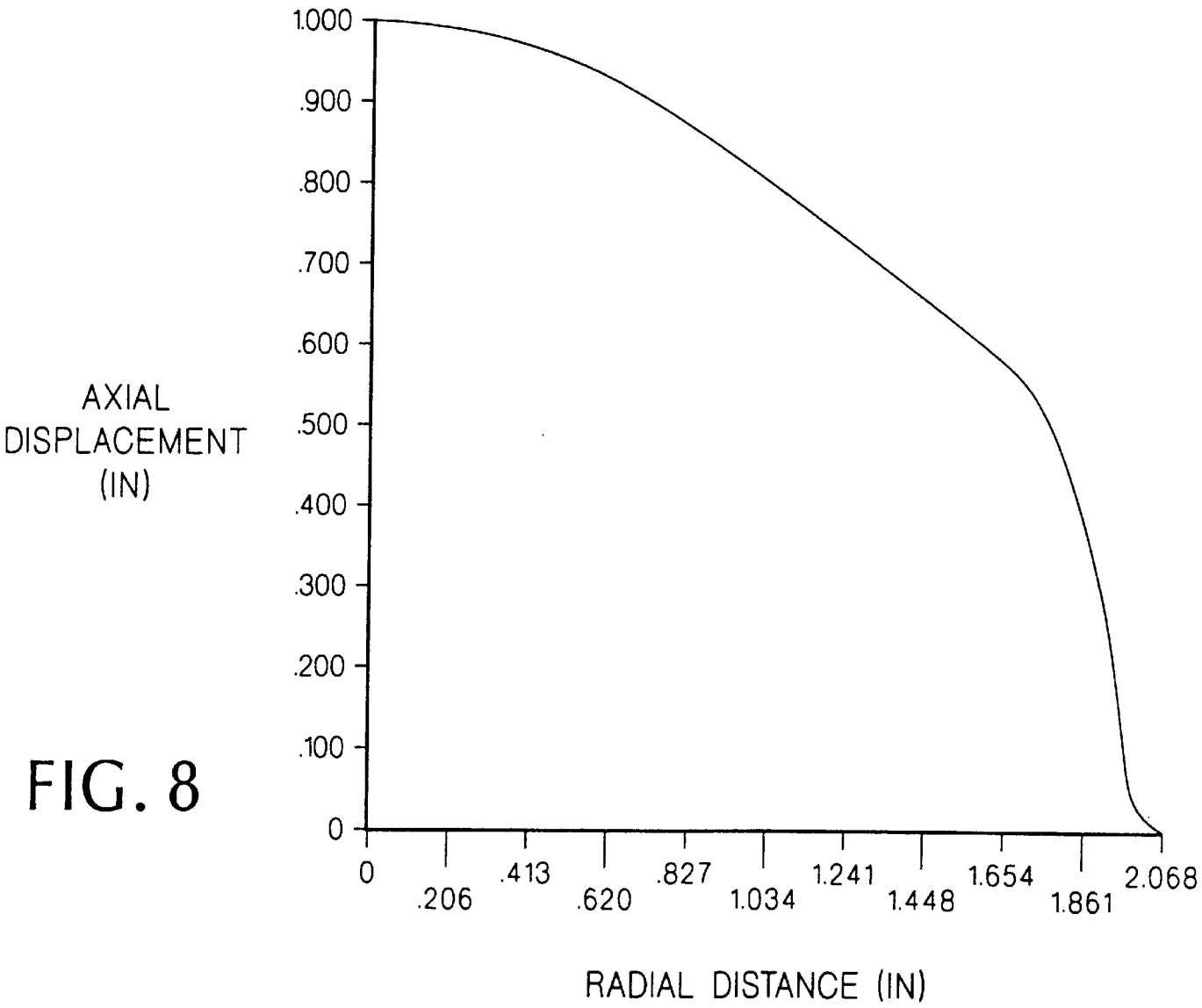
FIG. 8 is a graph of axial displacement versus radial distance for a flexural plate of the present invention.

FIG. 7 is a plot of axial displacement versus radial distance from the center of a conventional flexural plate and FIG. 8 is a plot of the same parameters for a flexural plate with a hinge according to the present invention. As the mode shape plots indicate, for a given displacement at the center of the plate, the hinged plate will displace a greater volume than the conventional plate. This increased volume is due to the hinge altering the mode shape of the flexural plate. The hinge allows for the ceramic face of the plate to move in a piston-like manner in which the ceramic face moves axially. A conventional plate will exhibit the classical cantilevered mode shape (FIG. 7) which has the surface displacement in a parabolic function. The increased volume displacement of the hinged plate provides an increase in the acoustic output of the transducer. Thus, for a given size, the hinged flexural plate transducer is capable of higher sound source levels than a comparable conventional flexural plate transducer.

Grooves 190, 192, 190', and 192' may be formed in their respective flexural plates by any suitable conventional means such as by machining, stamping, or casting.

It will thus be seen that the particular features, elements, and advantages of the present invention elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A flexural plate sound transducer, comprising:

(a) a housing having an open central volume;

(b) a flexural plate attached around an inner surface of said housing and extending across said central volume;

(c) at least one piezoelectric element attached to a surface of said flexural plate;

(d) a mechanical hinge formed in said flexural plate and extending around said flexural plate near an outer periphery thereof, said mechanical hinge being formed such as to cause said flexural plate to move in a substantially piston-like manner when said piezoelectric element is energized, and (e) said mechanical hinge being defined between two, concentric, radially displaced grooves formed in upper and lower surfaces of said flexural plate, the two grooves each located a different distance from the outer periphery of the flexural plate.

2. A flexural plate sound transducer, as defined in claim 1, wherein: said central volume is cylindrical, said flexural plate is round, and said mechanical hinge is formed from two concentric circular grooves cut into upper and lower surfaces of said flexural plate.

3. A flexural plate sound transducer, as defined in claim 1, wherein: said central volume is cylindrical, said flexural plate is round, and said mechanical hinge is formed from two complex grooves cut into upper and lower surfaces of said flexural plate.

4. A flexural plate sound transducer, as defined in claim 3, wherein: said complex grooves are sinusoidal in shape.

5. An underwater object detection system, comprising:

(a) first and second sonobuoys disposed in a body of water, said first and second sonobuoys having disposed at lower ends thereof first and second sound transducers, respectively; and (b) said first sound transducer being a sound generating transducer and said second sound transducer being a sound receiving transducer to receive sound waves generated by said first sound transducer and reflected from said underwater object;

at least said first sound transducer being a flexural plate sound transducer, comprising:

(c) a housing having an open central volume;

(d) a flexural plate attached around an inner surface of said housing and extending across said central volume;

(e) at least one piezoelectric element attached to a surface of said flexural plate;

(f) a mechanical hinge formed in said flexural plate and extending around said flexural plate near an outer periphery thereof, said mechanical hinge being formed such as to cause said flexural plate to move in a substantially piston-like manner when said- piezoelectric element is energized; and (g) said mechanical hinge being defined between two, concentric, radially displaced grooves formed in upper and lower surfaces of said flexural plate the two grooves each located a different distance from the outer periphery of the flexural plate.

6. An underwater object detection system, as defined in claim 5, wherein: said central volume is cylindrical, said flexural plate is round, and said mechanical hinge is formed from two concentric circular grooves cut into upper and lower surfaces of said flexural plate.

7. An underwater object detection system, as defined in claim 5, wherein: said central volume is cylindrical, said flexural plate is round, and said mechanical hinge is formed from two complex grooves cut into upper and lower surfaces of said flexural plate.

8. An underwater object detection system, as defined in claim 7, wherein: said complex grooves are sinusoidal in shape.

9. An underwater object detection system, comprising:

(a) a sonobuoy disposed in a body of water, second sonobuoy having disposed at a lower end thereof a sound transducer; and (b) said sound transducer being both a sound generating transducer and a sound receiving transducer to receive sound waves generated by said sound transducer and reflected from said underwater object; said sound transducer being a flexural plate sound transducer, comprising:

(c) a housing having an open central volume;

(d) a flexural plate attached around an inner surface of said housing and extending across said central volume;

(e) at least one piezoelectric element attached to a surface of said flexural plate;

(f) a mechanical hinge formed in said flexural plate and extending around said flexural plate near an outer periphery thereof, said mechanical hinge being formed such as to cause said flexural plate to move in a substantially piston-like manner when said piezoelectric element is energized; and (g) said mechanical hinge being defined between two, concentric, radially displaced grooves formed in upper and lower surfaces of said flexural plate; the two grooves each located a different distance from the outer periphery of the flexural plate.

10. An underwater object detection system, as defined in claim 9, wherein: said central volume is cylindrical, said flexural plate is round, and said mechanical hinge is formed from two concentric circular grooves cut into upper and lower surfaces of said flexural plate.

11. An underwater object detection system, as defined in claim 9, wherein: said central volume is cylindrical, said flexural plate is round, and said mechanical hinge is formed from two complex grooves cut into upper and lower surfaces of said flexural plate.

12. An undewater object detection system, as defined in claim 11, wherein: said complex grooves are sinusoidal in shape.

* * * * *